US008186316B2

(12) United States Patent
Evgeni et al.

(10) Patent No.: US 8,186,316 B2
(45) Date of Patent: May 29, 2012

(54) OPPOSITE RADIAL ROTARY-PISTON ENGINE OF CHORONSKI-MODIFICATION

(76) Inventors: Choronski Evgeni, Ashkelon (IL); Boris Moukhaev, Ashdod (IL)

( * ) Notice: Subject to any disclaimer, the term of this patent is extended or adjusted under 35 U.S.C. 154(b) by 802 days.

(21) Appl. No.: 12/221,006

(22) Filed: Jul. 30, 2008

(65) Prior Publication Data

US 2009/0314251 A1 Dec. 24, 2009

Related U.S. Application Data

(63) Continuation-in-part of application No. 12/214,488, filed on Jun. 19, 2008, now Pat. No. 7,832,368.

(51) Int. Cl.

| | |
|---|---|
| ***F02B 25/00*** | (2006.01) |
| ***F02B 33/22*** | (2006.01) |
| ***F02B 41/06*** | (2006.01) |
| ***F02B 25/08*** | (2006.01) |
| ***F02B 57/00*** | (2006.01) |
| ***F01B 3/00*** | (2006.01) |

(52) U.S. Cl. ..... 123/70 R; 123/51 B; 123/51 BD; 123/45 R; 123/43 R

(58) Field of Classification Search ..... 123/70 R, 123/51 R, 51 A, 51 B, 51 BD, 51 BA, 65 BA, 123/45 R, 43 R See application file for complete search history.

(56) References Cited

U.S. PATENT DOCUMENTS

| | | | | | |
|---|---|---|---|---|---|
| 1,485,988 | A | * | 3/1924 | Michel | 123/51 B |
| 2,055,352 | A | * | 9/1936 | Kahn | 123/65 BA |
| 2,066,489 | A | | 1/1937 | Shannon | |
| 2,117,700 | A | * | 5/1938 | Burkhardt | 123/51 BA |
| 2,347,444 | A | * | 4/1944 | Vincent | 123/70 R |
| 2,377,068 | A | * | 5/1945 | Bolli | 123/51 BD |
| 2,527,424 | A | | 10/1950 | Johansson | |
| 2,687,931 | A | | 8/1954 | Flynn, Jr. | |
| 4,185,596 | A | | 1/1980 | Noguchi | |
| 4,312,305 | A | * | 1/1982 | Noguchi et al. | 123/70 R |
| 4,334,506 | A | | 6/1982 | Albert | |
| 4,357,916 | A | * | 11/1982 | Noguchi et al. | 123/70 R |
| 7,219,631 | B1 | | 5/2007 | O'Neill | |
| 7,832,368 | B2 | * | 11/2010 | Choronski et al. | 123/70 R |

OTHER PUBLICATIONS

Cassini oval (http://en.wikipedia.org/wiki/Cassini_oval )—3 pages.

* cited by examiner

*Primary Examiner* — Thai Ba Trieu
(74) *Attorney, Agent, or Firm* — Mark M Friedman

(57) ABSTRACT

A two-stroke opposite radial rotary-piston engine is proposed, comprising a block including sleeves, pairs of pistons disposed within the sleeves and oppositely movable, a power takeoff shaft, two parallel positioned rotors mounted thereon having an inner surface formed by a closed curved line. The rotors have concaved surface portions. Cross-like traverses are mounted, pair-wise spanning the pistons. The traverses are associated with engagement means, cooperating with the concaved portions. The engine comprises support bearings, coupled to the traverses. Support bearings include an external bushing, rolling over the rotor's inner surface, thereby impelling the rotor. The engagement means are mounted in the region of contact of the support bearings and rotors, thereby eliminating lateral force moment, extending the lifespan of the engine. Other elements, module engine embodiments with different angular positions of the rotors, and power installation embodiments are disclosed, enhancing the efficiency, size, weight, and power variety of the engine.

16 Claims, 9 Drawing Sheets

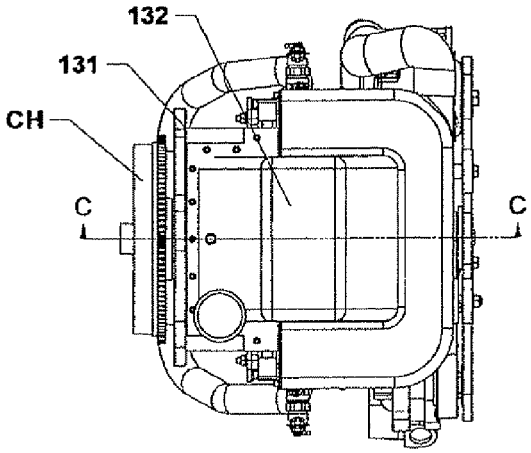
Fig. 1a
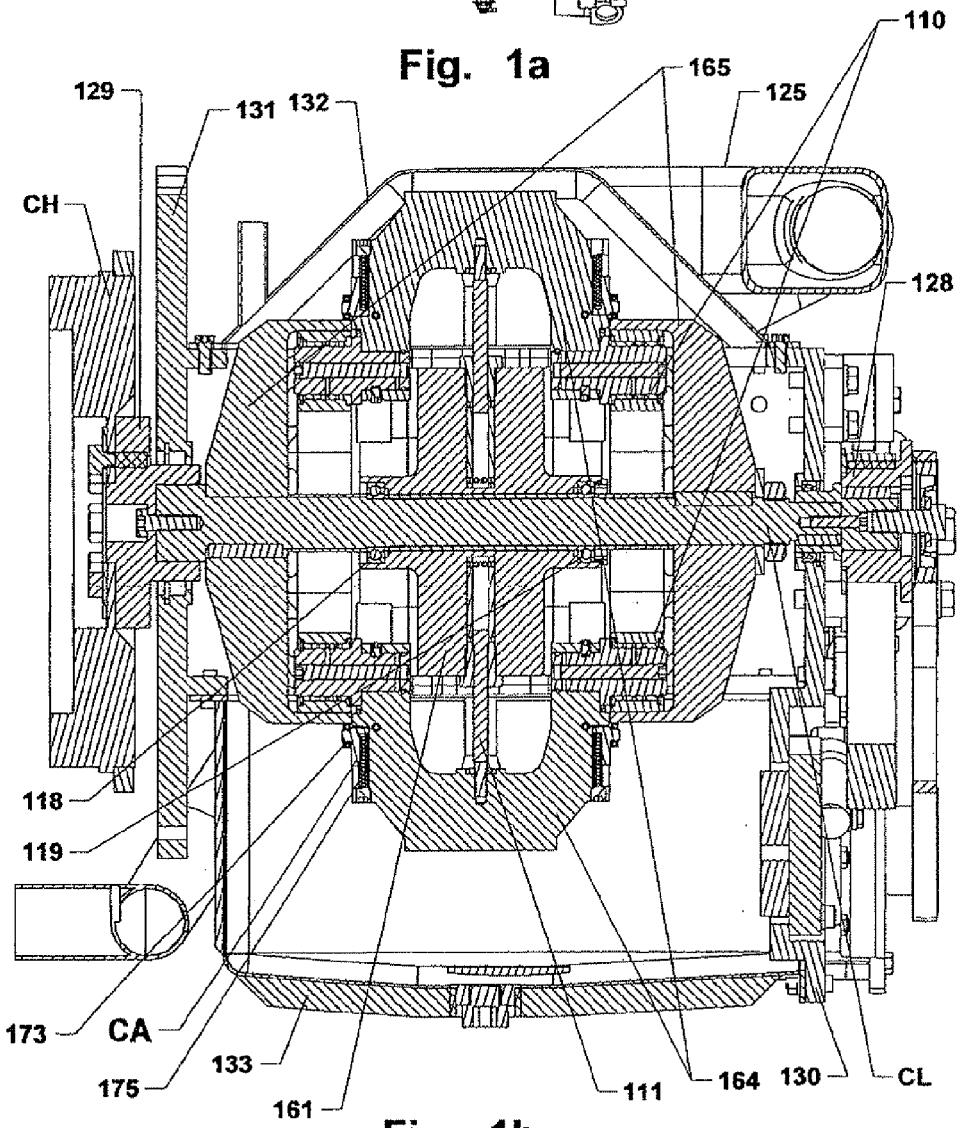
Fig. 1b Section C-C module "NM"

module "EM"

OPPOSITE RADIAL ROTARY-PISTON ENGINE OF CHORONSKI-MODIFICATION

CROSS REFERENCE TO RELATED APPLICATIONS

This U.S. patent application is a continuation-in-part application of a U.S. patent application Ser. No. 12/214,488 filed on Jun. 19, 2008, now U.S. Pat. No. 7,832,368 hereby entirely incorporated by reference (herein further referred to as "parent application").

FIELD OF THE INVENTION

The invention relates to opposite radial rotary-piston engines that can be utilized in ground vehicles, water vehicles, aircraft, in combinations with generators, etc.

BACKGROUND OF THE INVENTION

In the prior art there are known several constructions of centrifugal-piston or rotary-piston engines (herein further called ORPE), which are intended to eliminate certain disadvantages of conventional piston engines. E.g., such constructions are described in DE3907307, U.S. Pat. No. 6,279,518, U.S. Pat. No. 4,334,506, WO2005098202, RU2143572, and JP7113452. The latter, for instance, has the purpose "to suppress the side pressure applied to a piston, improve efficiency, reduce vibration and drastically reduce dimension and weight, by revolving a cam on the inner wall of an ellipse without using a crank, in reciprocating motion." The other above indicated constructions typically have similar purposes.

DE3907307 discloses a four-stroke engine wherein a cylinder block revolves inside a rotor, which is complicated, has a small resource of the valve system, and a des-balance with the revolving system including movable parts.

U.S. Pat. No. 6,279,518 discloses a four-stroke engine having a valve system and a conically shaped rotor. FIG. 7 shows a conical rotor with an elliptical groove, and a series of pistons followers inside the groove. It is a complicated unit with substantial friction losses, which has a limited operation resource for its loaded parts. The construction does not eliminate the side forces exerted by the piston upon the cylinder walls.

RU 2143572 discloses a four-stroke engine, wherein the cylinder block revolves at an elliptical trajectory, and the inlet/outlet system includes a rotatable valve. The construction is complicated and difficult to balance (which is admitted by its author). The piston acts via its rod and a sliding bearing upon an elliptical housing. The place of contact with the housing experiences high friction and heating, and thus will have a short operation resource.

From the instant inventors' point of view, a more advanced design of OPRE is presented in U.S. Pat. No. 6,161,508. It describes "a radial-piston engine of rotary type of the kind having a valve system comprising apertured disc rings arranged in intersliding relationship, one of said rings being stationary while the other one is arranged to take part in the rotary motion of the rotor. The valve opening relationship is determined by the manual angular positions of the discs. In accordance with the invention, filed injection takes place via an injection nozzle positioned in the stationary disc. The valve ring is formed with a through opening which in response to the position assumed my the rotor at the moment of fuel ignition forms an open communication means between the injection nozzle and the combustion chamber."

That engine however has also certain drawbacks and limitations. It is built as a four-stroke engine having a cylinder block revolving around and impelling a rotor. Reaction forces produced in support bearings are very significant that leads to a short operation resource period. It uses an inlet/outlet system based on a rotatable sliding valve. This necessitates the use of complicated sealing means that, as a rule, have very limited operation resource (typically 100 hours maximum). The rotating cylinder block with linearly reciprocating pistons is very hard to balance, and thusly will cause intensive destructive vibrations. These problems are successfully resolved in the present invention.

A reciprocating rotary engine is taught in U.S. Pat. No. 4,334,506: "Rotary engine having a hollow, stationary block with manifolds for air inlet and exhaust valving and means for supplying fuel. The block supports one or more in-line cylinders which are provided with opposed pistons equipped with rigid and constrained piston rods. The rods carry bearings that run along a cam track surface interior to a disc, the outer surface of which is a right circular cylinder. The surrounding right circular cylinder rotates as a result of the linear movement of the opposed pistons thereby providing mechanical power. The cam surface is a continuous track which determines the out-put motion of the piston movement between top and bottom dead center. Arcuate areas at top and/or bottom dead center permit constant volume combustion and/or exhaust as desired during a particular cycle, whether that cycle be Otto or Diesel and whether it be two or four stroke." At least one of drawbacks of that design is that the spark plugs 48 and fuel lines 46 are situated inside the rotor. Hence, their replacement would require dissembling the entire engine, which makes maintenance of the engine taught in U.S. Pat. No. 4,334,506 more difficult.

Another example of ORPE, described in U.S. patent application Ser. No. 11/827,595 filed on Jul. 12, 2007 by the instant applicants, employs a non-typical form of conversion of the spinning motion of a rotor into a progressive linear stroke of a piston, and vice versa. This constructive solution provides for substantial absorption of side forces exerted by the piston onto the engine cylinder's walls and vice-versa, and for an essential improvement of the weight and fuel consumption/power output ratios, demonstrating useful advantages over all presently utilized engines known to the applicants, including the Wankel rotor engine.

U.S. patent application Ser. No. 11/827,595, hereby entirely incorporated by reference, discloses a two-stroke opposite rotary-piston engine that comprises a cylinder block including a sleeve and two pistons slidely disposed therein and oppositely movable, which pistons are forming a common combustion chamber situated between their heads, and forming a first gap with sleeve's sidewalls; a rotor having a surface formed by a closed symmetrical Cassini line (particularly, ellipse); traverses attached to the pistons; rollers attached to the traverses and springly depressed against the rotor; oil tubes with end bushings; oil supply and withdraw means; two plungers disposed in each tube forming a second gap with the tube's sidewalls, essentially less than the first gap. The plungers are attached to the traverses and oppositely movable, also including through throttling channels, outward surfaces forming external spaces with the bushings, and inward surfaces forming an internal space with the tube sidewalls, which internal space communicates with the oil supply means and the oil withdraw means. Engine's oil drain means communicate the external spaces with the oil supply means. The engine absorbs side and inertial forces, is more efficient and clean.

However, the design of engine taught in U.S. patent application Ser. No. 11/827,595 has certain drawbacks: the rotor has a significant size and weight, the support roll bearings don't allow absorbing high loads, which shortens the service lifespan thereof. The power takeoff is carried out upon each 180-degree turn, i.e. the load characteristic is uneven that also reduces the lifespan and efficiency of that engine.

The design ideas are further developed in the parent application that proposes a two-stroke opposite radial rotary-piston engine, "comprising a block including sleeves, pairs of pistons disposed within the sleeves and oppositely movable, guiding bearings, a power takeoff shaft, rotors mounted thereon having an inner surface formed by a closed curved line, the rotors' transverse axes are predeterminedly disposed. On the frontal part, the rotors have concaved surface portions along the curved line. T-like traverses are mounted, pair-wise spanning the pistons. The traverses include convex protrusions, cooperating with the concaved portions during the start of the engine. A clearance between the concaved and convex portions is provided after the start. The engine comprises support bearings, coupled to traverses. Support bearings include an external bushing, rolling over the inner surface of the rotor associated with the traverse, thereby impelling the rotor."

Further analysis of the engine presented in the parent application (particularly its module embodiment EM shown on FIGS. 4*a* and 5*a* thereof) has revealed the following design shortcomings: (a) the support bearings experience relatively high load that diminishes their service life; (b) the traverse's protrusion A (FIG. 1*b* of the parent application) is designed to provide strike-less start of the engine, while clearance between the concaved surface M of the rotor and the convex protrusion A is provided after the start; however when the start is provided by a starter, the rotor can be engaged with the protrusion A in a strike-like manner that may cause breakage of one of these elements; (c) a bending force moment $MB=R_{2\times}a$, causes a higher wear of the friction pair of the piston and the slipper bearing that also shortens their service life.

BRIEF SUMMARY OF THE INVENTION

A two-stroke opposite radial rotary-piston engine is proposed in the present disclosure, comprising a block including sleeves, pairs of pistons disposed within the sleeves and oppositely movable, a power takeoff shaft, two parallel positioned rotors mounted thereon having an inner surface formed by a closed curved line. The rotors have concaved surface portions. The engine comprises cross-like traverses pair-wise spanning the pistons. The traverses are associated with engagement means, cooperating with the concaved portions. The engine comprises support bearings, coupled to the traverses. Support bearings include an external bushing, rolling over the rotor's inner surface, thereby impelling the rotor. The engagement means are mounted in the region of contact of the support bearings and rotors, thereby eliminating a lateral force moment, extending the lifespan of the engine. Other elements, module engine embodiments with different angular positions of the rotors, and power installation embodiments are disclosed, enhancing the efficiency, size, weight, and power variety of the engine. The design of the inventive engine allows eliminating or significantly reducing the aforementioned shortcomings of the engine described in the parent application.

BRIEF DESCRIPTION OF THE DRAWINGS

FIG. C1*a* illustrates a plan view of the engine consisting of one module NM according to a preferred embodiment of the present invention.

FIG. C1*b* illustrates a lateral cross-sectional view of the engine, according to the preferred embodiment of the present invention shown on FIG. C1*a*.

Figure 2B:
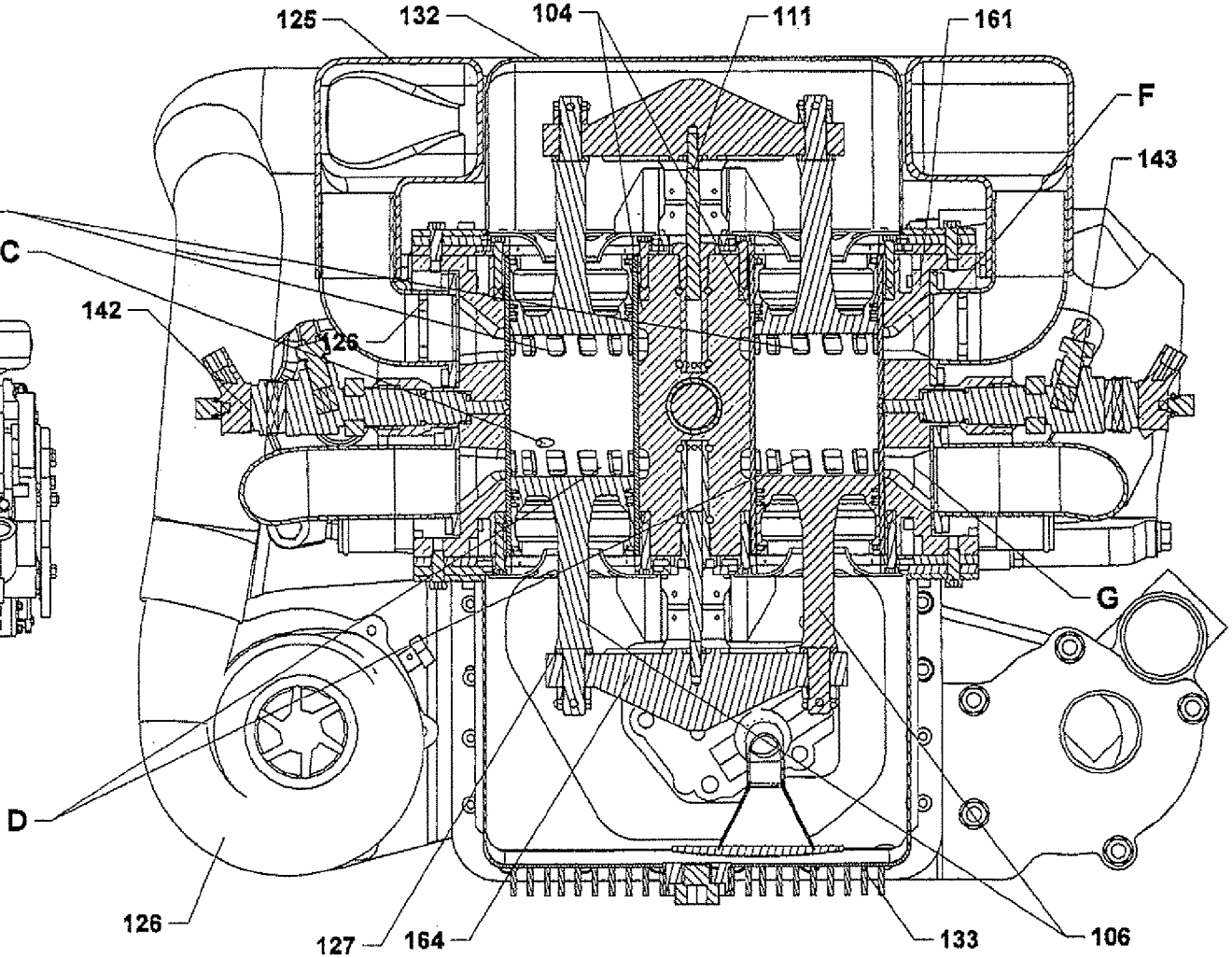
Figure 2A:
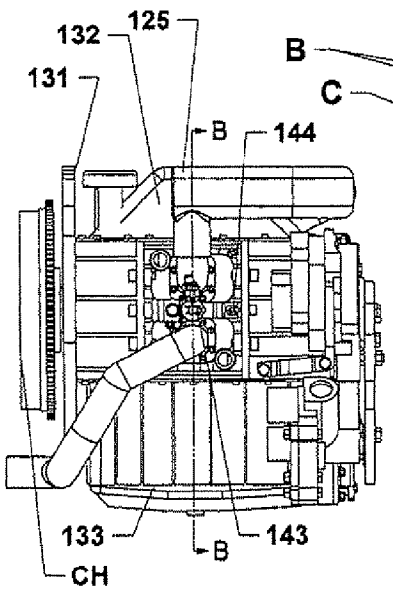
Figure 2C:
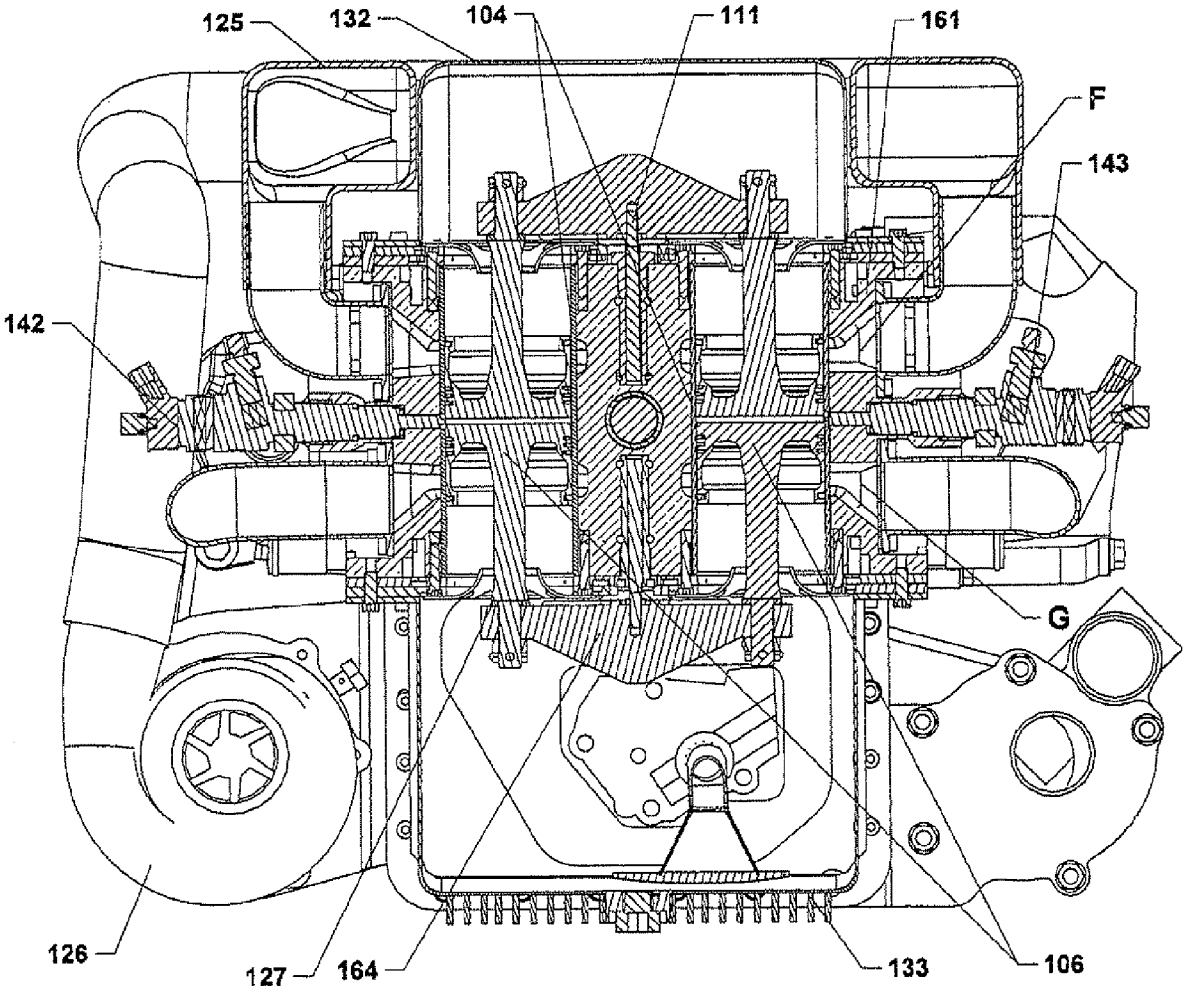
Figure 2D:
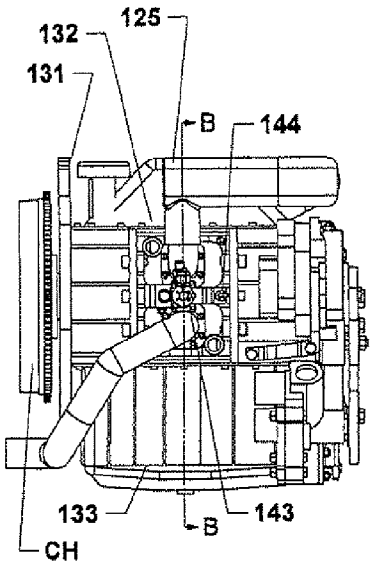
Figure 3:
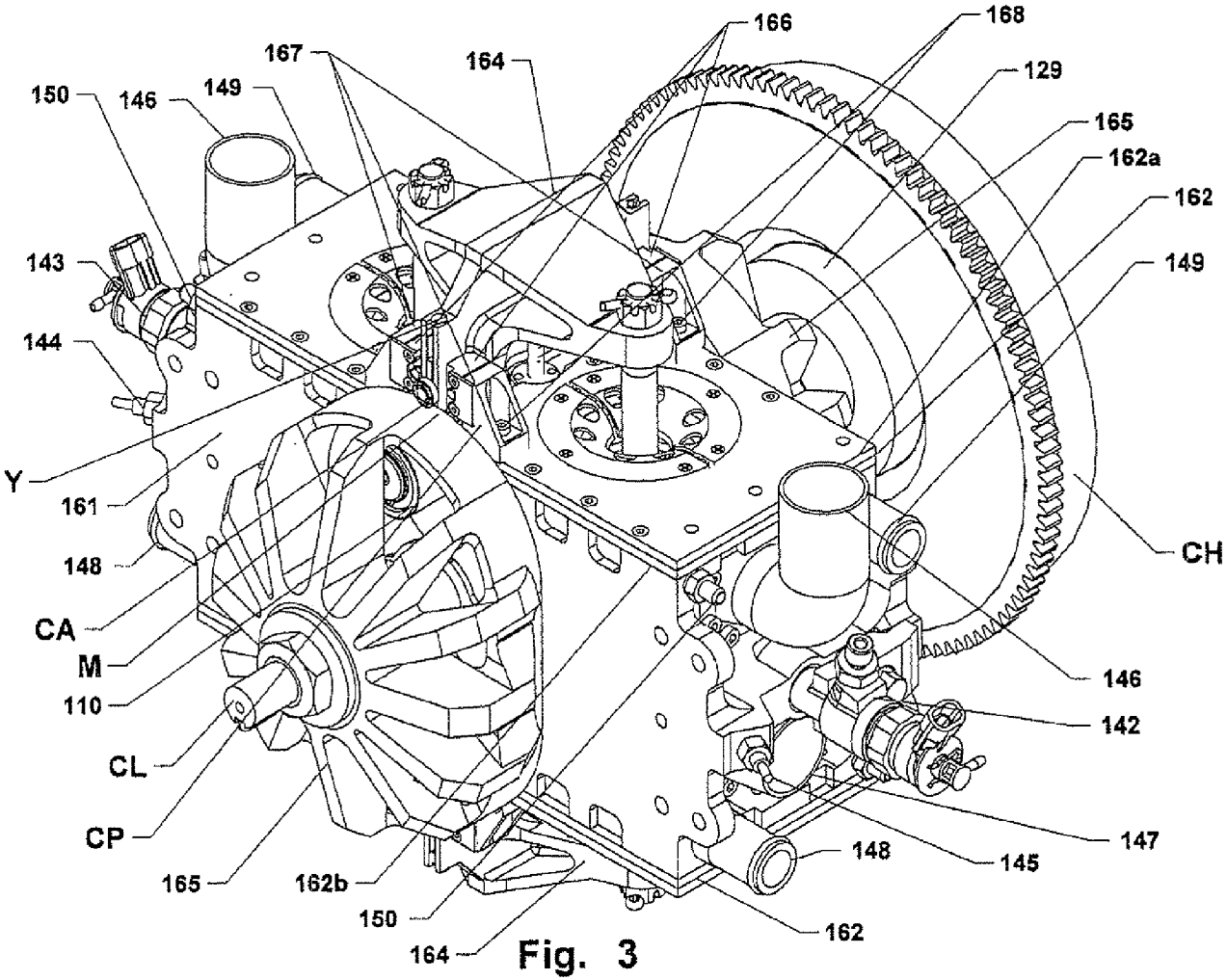
Figure 3A:
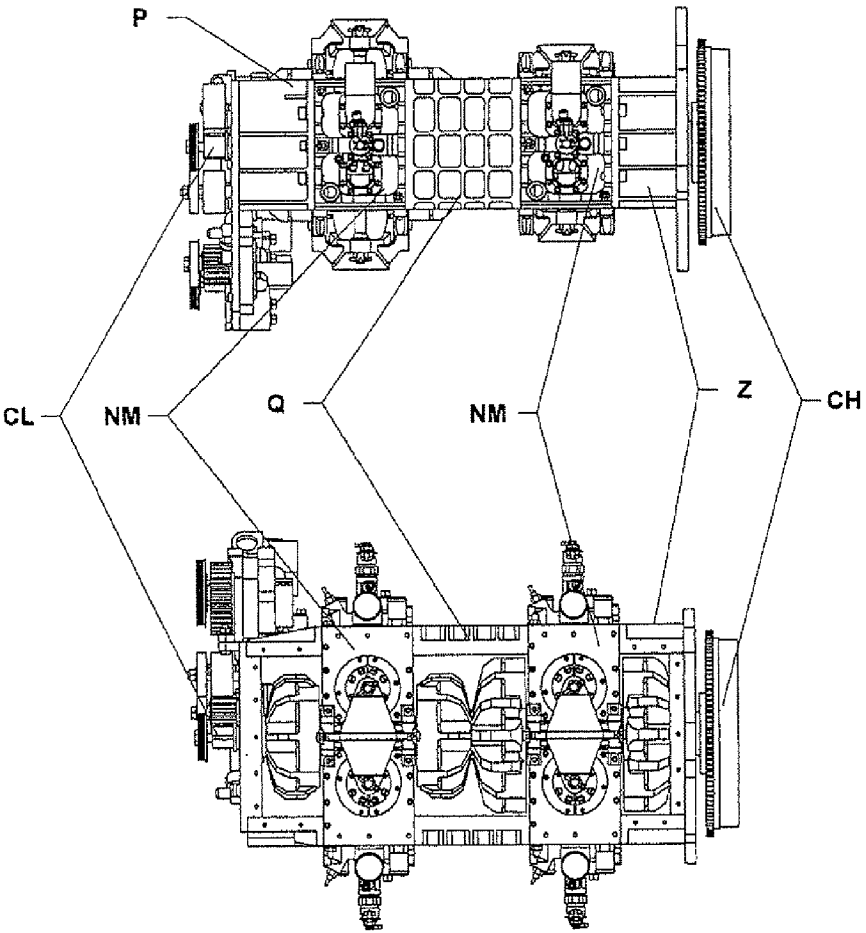
Figure 3B:
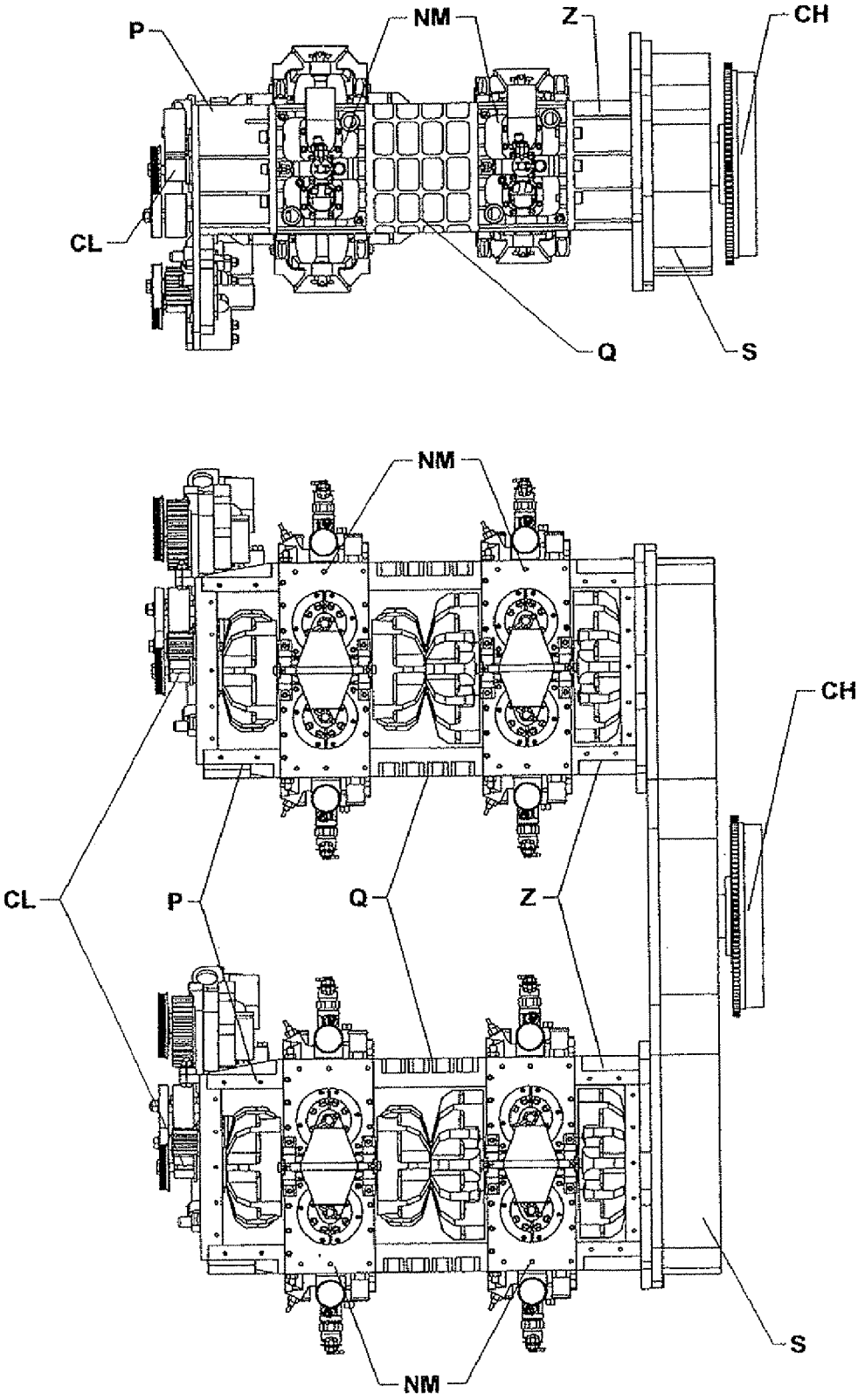
Figure 4C:
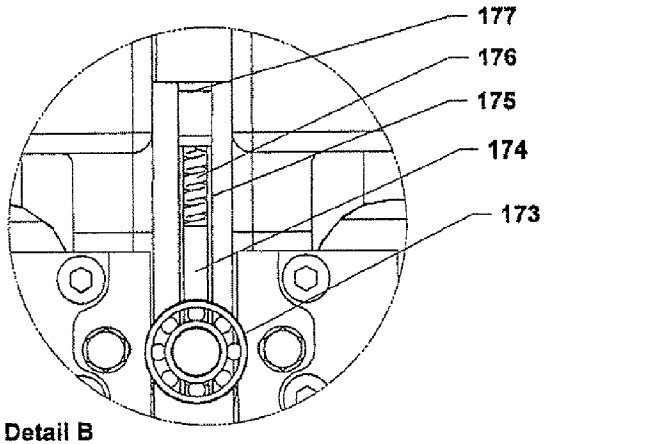
Figure 4D:
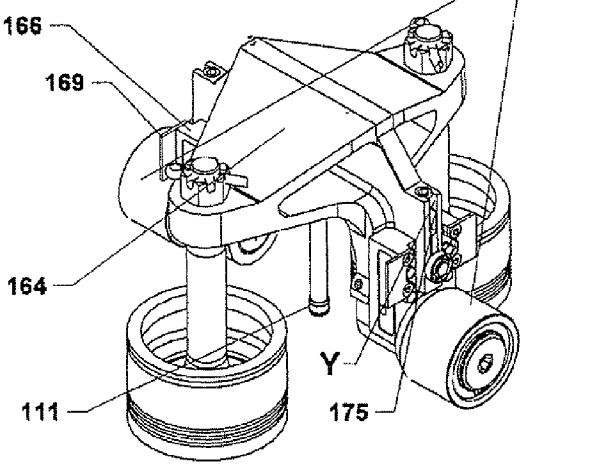
Figure 4A:
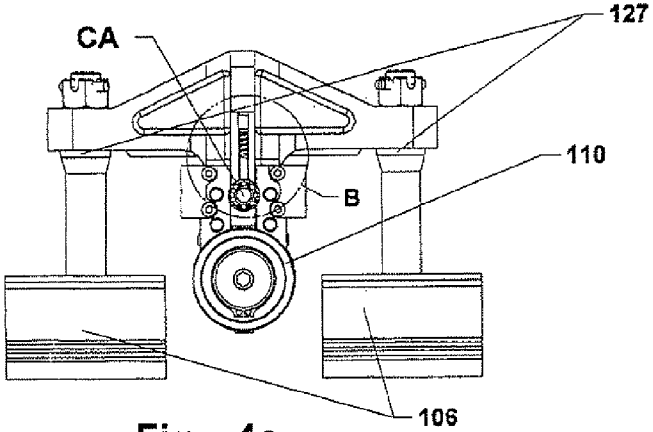
Figure 4B:
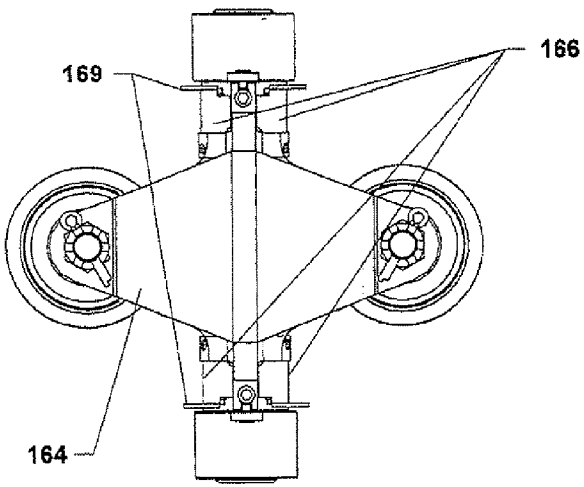
Figure 5B:
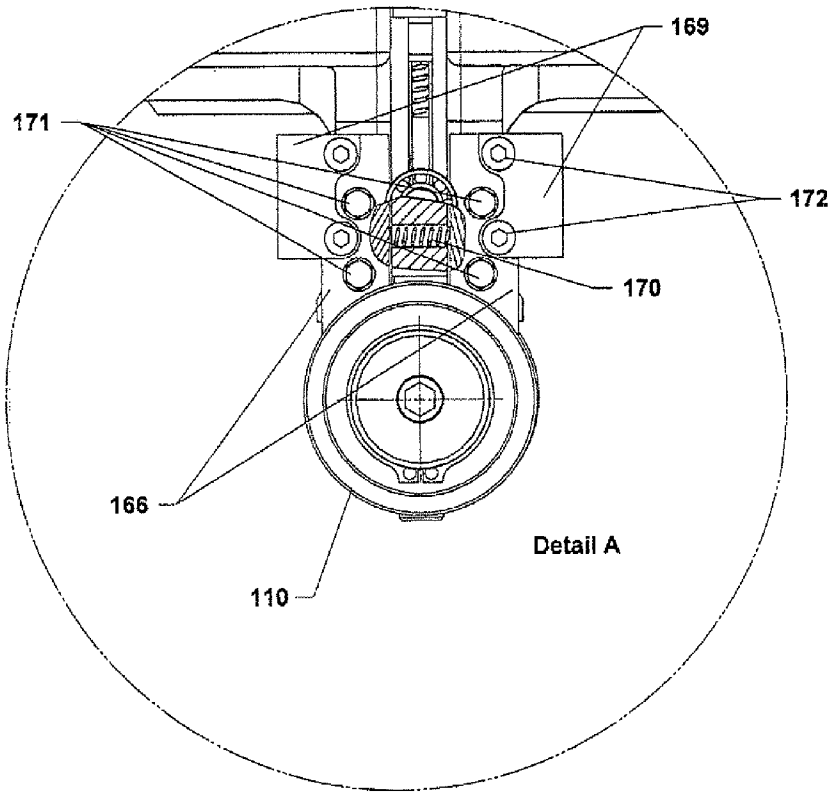
Figure 5A:
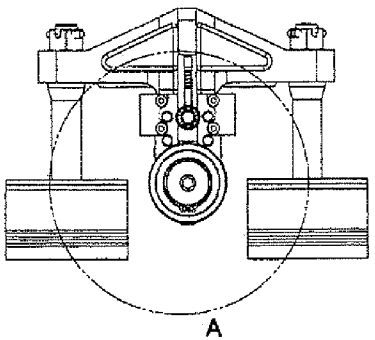
Figure 6B:
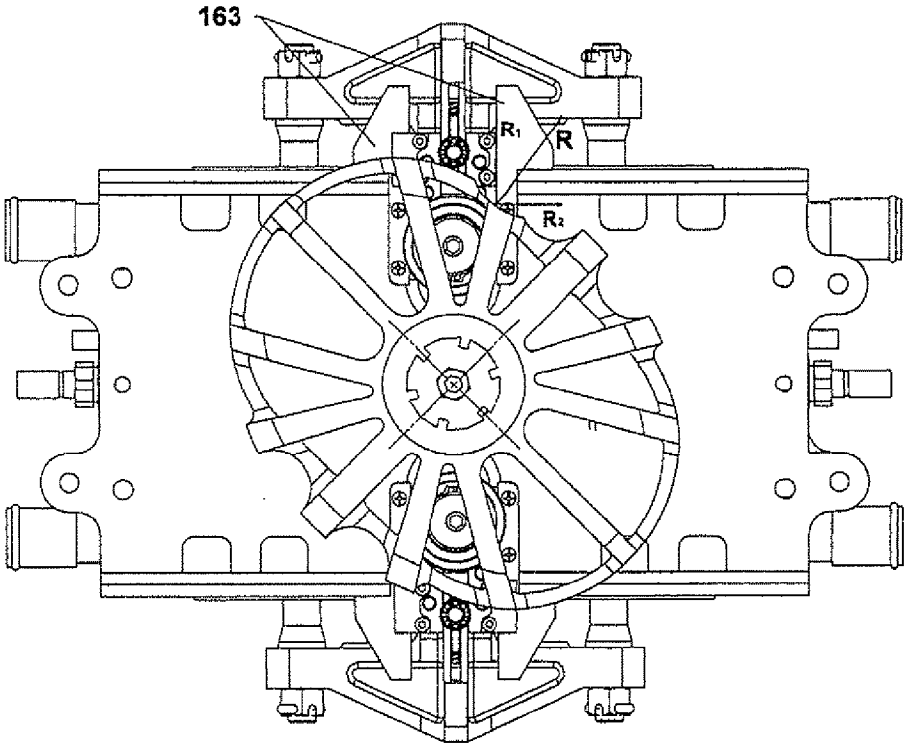
Figure 6A:
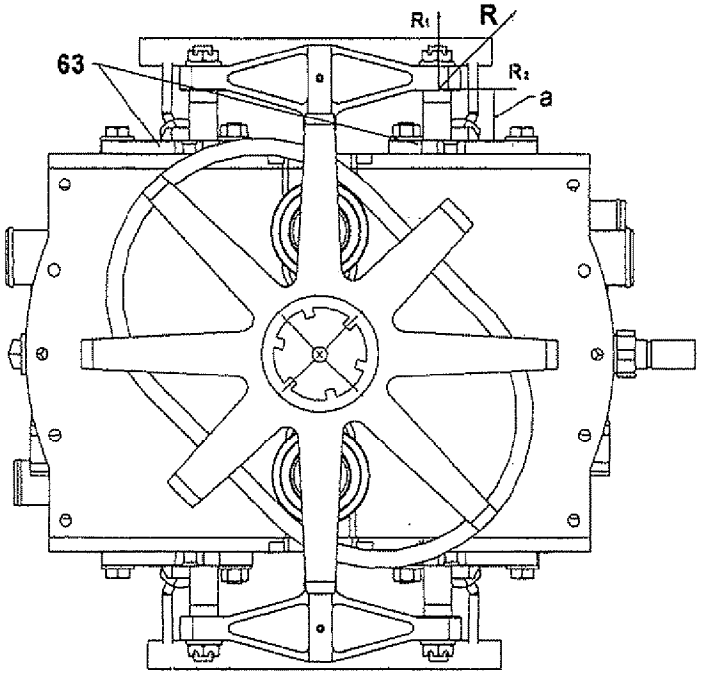

FIG. C2*a* illustrates a frontal view of the engine, according to a preferred embodiment of the present invention.

FIG. C2*b* illustrates a frontal cross-sectional view of the engine where the pistons are positioned maximally close to each other, according to the preferred embodiment of the present invention shown on FIG. C2*a*.

FIG. C2*d* illustrates frontal cross-sectional view of the engine consisting of one module NM, according to a preferred embodiment of the present invention.

FIG. C2*c* illustrates a frontal cross-sectional view of the engine where the pistons are positioned maximally far from each other, according to the preferred embodiment of the present invention shown on FIG. C2*d*.

FIG. C3 illustrates an isometric view of the engine consisting of one module NM, according to a preferred embodiment of the present invention.

FIG. C3*a* illustrates frontal and plan views of a two-module engine comprising two modules NM, according to an embodiment of the present invention.

FIG. C3*b* illustrates frontal and plan views of a power installation comprising two two-module engines shown on FIG. C3*a*, according to an embodiment of the present invention.

FIG. C4*a* illustrates a schematic frontal sectional view of an engine, according to a preferred embodiment of the present invention.

FIG. C4*b* illustrates a plan view of an engine, according to the preferred embodiment of the present invention shown on FIG. C4*a*.

FIG. C4*c* illustrates a partial detail view of an engine, according to the preferred embodiment of the present invention shown on FIG. C4*a*

FIG. C4*d* illustrates an isometric view of an engine, according to the preferred embodiment of the present invention shown on FIG. C4*a*.

FIG. C5*a* illustrates a schematic frontal sectional view of an engine, according to a preferred embodiment of the present invention.

FIG. C5*b* illustrates a partial detail view of the engine, according to the preferred embodiment of the present invention shown on FIG. C5*a*

FIG. C6*a* illustrates a schematic frontal sectional view of an engine, according to the module EM embodiment of the parent application.

FIG. C6*b* illustrates a schematic frontal sectional view of an engine, according to a preferred embodiment of the present invention.

Identical reference numerals in the drawings generally refer to the same elements in different figures, unless otherwise is specified in the description. A newly introduced numeral in the description is enclosed into parentheses.

DESCRIPTION OF A PREFERRED EMBODIMENT OF THE INVENTION

While the invention may be susceptible to embodiment in different forms, there are shown in the drawings, and will be described in detail herein, specific embodiments of the present invention, with the understanding that the present disclosure is to be considered an exemplification of the principles of the invention, and is not intended to limit the invention to that as illustrated and described herein.

A preferred embodiment of the inventive engine is a two-stroke internal combustion engine featuring oppositely disposed pistons movable toward each other, which movement is converted into the spinning of rotors, also featuring the straight blowing of air through cylinders with the straight injection of fuel, and with liquid cooling. The inventive two-stroke engine can be embodied as a number of modules (herein called module 'NM' distinctly from the module 'EM' introduced in the parent application), and these modules can be assembled into a more powerful module engine, a number of which module engines, in turn, can be assembled into a power installation.

The inventive engine illustrated on FIGS. C1*a*, C1*b*, C2*a*, C2*b*, C2*c*, C2*d*, C3, C4*a*, C4*b*, C4*c*, C4*d*, C5*a*, C5*b*, and C6*b* comprises a hollow stationary cylinder block (161) fixedly mounted, e.g. on a vehicle; a frontal housing (130) and a rear housing (131) fixedly mounted, e.g. on a vehicle; the housings 130 and 131 are coupled with the block 161 by bolts and an upper lid (132) and a bottom oil tray (133). The aforementioned elements are preferably made by means of casting. The block 161 is the power core of the engine. Two cylinders or sleeves (104) are mounted on the block 161 preferably by hot coupling. Two covers (162) (top and bottom covers) close the block 161 at the top and bottom, forming a common cooling jacket. The covers 162 each comprises an upper part (162*a*) and a lower part (162*b*) having cooperation surfaces with concavities milled-out for oil supply, which oil is deployed for lubrication and cooling different parts of the engine as described below. Oil is delivered to the covers 162 via oil-intake pipes (150).

The inventive engine comprises four pistons (106): the upper pair and the lower pair of pistons. One upper piston 106 and one lower piston 106 are slidely snug-fitted within the first sleeve 104. The other upper piston 106 and the other lower piston 106 are slidely snug-fitted within the second sleeve 104. Each piston 106 consists of a body and a rod. The body has a head oppositely situated to the rod. The pistons 106 are positioned in each sleeve 104 and oppositely linearly movable in relation to each other forming a common chamber defined by the pistons' heads and a portion of the inner sidewalls of the sleeve situated between the heads.

Distinctly from the engine described in the parent application where the piston's body is preferably made of an appropriate aluminum alloy and the rod is made of steel with precise processing, in the instant invention the engine's piston, the body and the rod are preferably made of an appropriate aluminum alloy. The heads of the pistons' bodies, facing each other, and a portion of the inner sidewalls of the sleeve 104 between the heads define a chamber that can be a blowing off or an intermingling chamber, or a combustion chamber depending on the phase of engine's operation.

The engine comprises a receiver (125) and a conventional supercharger pump (126), shown on FIGS. C2*b* and C2*c*, to introduce air into the chamber. The engine comprises an inlet window (B) and outlet window (D) made in the sleeve 104, correspondingly communicating with an intake channel (F) and an exhaust channel (G) made in the block 161 (shown on FIG. C2*b*, like in the engine of the parent application).

Similarly to the parent application's engine, in preferred embodiments of the instant invention, the sleeve 104 has an orifice C communicating with the channel F (shown on FIG. C2*b*) for supply of air after the windows B and D are shut during a 6-7 degree turn of a power takeoff shaft that is described below. This enhances the filling of the sleeves with a fresh air portion during the mentioned angular turn. It allows achieving the coefficient of filling the sleeve to be equal to 1.0. Besides, the orifice C is made at the tangential direction to the sidewalls of the sleeve 4, which additionally whirls the air in the sleeve, and improves the quality of the fuel-air mixture. The closing or opening of the windows B and D and the orifice C are provided by the pistons 6 during their movement within the sleeve 4. Configurations of the windows B and D and orifice C, their areas, and dispositions can be determined empirically for a particular design of the engine.

The inventive engine comprises two cross-shaped traverses (164): the upper traverse and the lower traverse (shown on FIGS. C1*b*, C2*b*, C2*c*, C3, C4*b*, and C4*d*). The two rods of the upper pistons 106 are spanned with the upper traverse 164, and the two rods of the lower pistons 106 are spanned with the lower traverse 164. The rods are attached to the traverses 164 preferably by means of a screw connection (FIGS. C2*b*, C2*c*, C3). Due to the screw connection, it is possible to regulate the length of the rod during the assembling by means of a distance washer (127), mounted on the rod, that allows controlling the extent of compression of the engine.

As illustrated on FIGS. C1*b* and C3, the block 161 contains a power takeoff shaft (CL), extending along the symmetry axis of the block 161, and perpendicularly the longitudinal axis of the sleeves 104. As depicted on FIG. C3, the block 161 houses: injectors (142, 143), spark plugs (144, 145) (or incandesced plugs for a diesel engine), supply and withdraw pipes for cooling liquid (148, 149), oil inlet connector pipes (150), attachment means of air inlet pipes (146), and exhaust gas outlet pipes (147), all installed on the outer sides of the block 161.

The shaft CL is rotatably mounted on the block 161, and is supported by two rolling bearings (118) and (119) mounted in the block 161, shown on FIG. C1*b*. The shaft CL extends through the openings in the housings 130 and 131.

The engine comprises two substantially identical rotors (165) mounted on the shaft CL, situated outwardly in relation to the housings 130 and 131, as illustrated on FIG. C3, and fixed to the shaft CL preferably by dowels. The rotors 165 are disposed substantially symmetrically in relation to the central cross-section plane positioned perpendicularly to the longitudinal axis of shaft CL of the engine.

It can be said that the inventive engine has one rotor divided into two rotors mounted on both sides of the engine with the purpose of essentially equal distribution of the load (force produced by expanding gases in the sleeves) into two flows between the two rotors and corresponding support bearings (described herein below) interacting therewith. In other words, each rotor assumes only a half of the load. This eliminates the above-mentioned shortcoming (a) of the engine described in the parent application thereby extending the service lifespan of the rotors and support bearings. Alternatively, leaving the service lifespan unchanged, the power of module NM can be increased essentially twice (e.g. by increasing the cross-section area of the pistons) comparatively to the module EM described in the parent application.

The inner surface of the rotors 165, facing the housing 130 (or housing 131), has a cylindrical geometrical shape with its periphery formed by a generatrix moved along a predetermined Cassini line. In the preferred embodiment, it is an oval with suitable parameters, having a long (longitudinal) axe and a short (transverse) axe, wherein the length difference between the long and short axes is preferably equal to a double length of the stroke of the pistons 106. The corresponding axes of the rotors are aligned in parallel to each other.

Similarly to the engine of parent application, on the outer surface of each of the rotors, in its frontal part adjacent to the housing, a surface portion (M) is arranged (preferably milled out), formed by the predetermined Cassini line, preferably, an oval, as shown on FIG. C3. As described herein below, each rotor 165 is essentially associated (via support bearings) with both the upper and lower traverses 164 that allows taking off power from the two pistons simultaneously to one rotor and therefore from four pistons to two rotors, increasing effectiveness of the engine's operation and reducing the wear of the rotors and respective support bearings.

Pinions of a supplemental equipment drive (128) and a nave (129) of a fly-wheel (CH) are secured on the shaft CL as shown on FIG. C1*b*.

As illustrated on FIG. C1*b*, C3, and C4*a*, each traverse 164 is coupled with a pair of engagement units (CA), capable of cooperating with the aforementioned surface M of the rotor, and a nest, arranged for mounting a slide of a hydro-lock (111). The hydro-lock serves for taking off inertial loads applied to the rotor in dead points, which loads are produced by the moving traverse and the pistons. Its operation was described in U.S. Ser. No. 11/827,595.

The engagement unit CA is differed from the protrusion A, arranged in the engine of the parent application. There is a predetermined clearance between the surface of protrusion A and the surface M. The protrusion A is used during the start of the engine, as described in the parent application, and is taken out during the normal operation of the engine.

The engagement unit CA of the instant inventive engine is made movable, and including an engagement slide (174) capable to slide along an engagement guide (175), illustrated on FIGS. C4*c* and C4*d*. A rolling bearing (173) is mounted on the slide 174. Due to an engagement spring (176), situated inside the guide 175, and fixed by a screw (177) shown on FIG. C4*c*, the engagement unit CA is permanently springly depressed against the rotor 165, and, at the same time, has a freedom to move, providing a strike-less engagement of the rotors during a start. This allows eliminating the aforementioned shortcoming (b).

Two conventional support bearings (110), preferably of a slipper type, are mounted on each traverse 164 illustrated on FIGS. C1*b*, C3, C4*a* and C4*d*, which bearings 110 deploy liquid friction. The bearing 110 comprises an external cylindrical ring, an internal cylindrical ring, and a revolvable insertion therebetween. The external ring rolls over the inner surface of the rotor 165 impelling it, and thereby converting the linear movement of the traverse 164 into rotation of the rotor.

The inventive engine comprises two pairs of guiding bearings (163), preferably of a slipper type, entirely depicted on FIGS. C3 and C6*b*. The guiding bearing 163 absorbs lateral forces R2 produced during interactions of the support bearings 110 with the rotors 165. Unlike the guiding bearings of the parent application's engine (e.g. module EM depicted on FIG. C6*a*), the guiding bearings 163 are mounted in the region of contact of the support bearings 110 with the rotors 165 (depicted on FIG. C6*b*), which allows eliminating the above-mentioned shortcoming (c).

Each guiding bearing 163 comprises a movable part consisting of two slides (166), shown on FIGS. C3, C4*b*, C4*d*, and C5*b*, and an immovable part (167), shown on FIG. C3. The slides 166 are fixed by bolts (171) to the traverse 164. The immovable part 167 is secured by bolts (168) to the block 161. The traverse 164 includes a hole, wherein a spring (170) is inserted as depicted on FIG. C5*b*, which spring 170 tends to repel the two slides 166 secured to the same traverse 164.

The spring 170 allows providing a clearance-less assembling of the guiding bearing 163, as well as elimination of a clearance that may appear during maintenance. Such elimination is provided by releasing the bolts 171 with their subsequent tightening.

Two plan-washers (169) are secured on the slides 166 by means of bolts (172). The plan-washers 169 are supported by a surface (CP) of the immovable part 167, shown on FIG. C3. This provides a longitudinal displacement of the traverse 164 within the plane perpendicular to the axe of the shaft CL (FIG. C3), substantially without a transverse displacement thereof. Each plan washer 169 is attached to the slide 166 via springed-washers (not shown) providing clearance-less assembling and maintenance.

As mentioned above, oil is supplied via the oil-intake pipes 150 to the covers 162. The oil is further delivered for cooling the pistons 106, and for lubrication of the guide bearings 163, the support bearings 110, and the bearings 118 and 119 of the shaft CL.

The process of fuel injection is regulated by a conventional pre-programmed control unit (not illustrated).

Operation of the Inventive Engine

The engine operates as follows:

At start time, the fly-wheel CH begins revolving, driven by an outside source (e.g., electro-starter, air-starter, kick-starter, etc.), and conveys the rotation via the shaft CL to the rotors 165, and a pinion of the supplemental equipment drive 128. Through a belt transmission, the pinion drives the supercharger 126 that pumps air into the sleeves 104, at a predetermined pressure.

While rotating, the rotors 165 drive pistons 106 by means of the engagement units CA of the traverse 164. The movement of the pistons controls the intake of air and the exhaust of gases.

Exemplary operation of the rotor is shown on FIGS. C2*b* and C2*c*. In the position illustrated on FIG. C2*c*, the pinions 106 are situated in the upper dead point and shut the inlet window B and outlet window D. In the course of rotation, the rotor via the engagement units CA displaces the pistons toward the lower dead point, which causes opening the inlet window B and outlet window D, and a portion of fresh air under pressure is introduced into the sleeve.

Thereafter, the rotor drives the bearings 110 toward the upper dead point, which bearings shut first the inlet windows B, and then the outlet windows D. Then, within the additional 6-7 degree turn, the orifice C (shown on FIG. C2*b*) is still open, that allows filling the sleeve 104 with a portion of fresh air as it's described in the parent application. Since the orifice C is aligned tangentially to the sidewalls of the sleeve, an intense whirling of air will occur, enhancing the intermingling of the fuel-air mixture.

In the course of 180-degree revolving, the pistons arrive into the upper dead point, compressing air in the sleeve. At a predetermined point, preceding the upper dead point, the pre-programmed control unit sends a command to inject fuel into the combustion chamber of the sleeve 104.

At this time, the fuel-air mixture is ignited and the engine begins the work process. From this moment, increased pressure of air or gases is permanently present in the sleeve, which pressure via the pistons 106 and traverse 164 causes the support bearings 110 to be depressed against the inner surface of rotor 165. The rotors 165 rotate and convey a predetermined torque via the shaft CL, e.g. onto a gear of a car, helicopter, boat, or power installation.

Assembling Modules Into a Module Engine

As mentioned above, the inventive engine is embodied as a number of associated modules NM, and the number of such modules can be assembled into a more powerful module engine, which module engines, in turn, can be assembled into a power installation comprising several such module engines. The number of modules is determined based on the purpose for which the engine would be employed. The assembled module engine may have a common power takeoff shaft for all modules, or a separate shaft for each module or a group of modules, and such separate shafts are connected through appropriate conventional muffs or clutches.

FIG. C3*a* illustrates a module engine assembled of two modules NM (the beginning module and the ending module) described herein above. It comprises a common shaft CL, wherein the housings 130 and 131 of each module substantially support a corresponding portion of the shaft CL, which portion is rotatably mounted in the bearings 118 and 119. The module engine comprises a common fly-wheel CH coupled with the ending module, a front cover (P) disposed at the terminating end of the beginning module and covering the left rotor thereof, a rear cover (Z) disposed at the terminating end of the ending module and covering the right rotor thereof, and an intermediate cover (Q) inserted between the modules and covering the right rotor of the beginning module and the left rotor of the ending module. In the case of common shaft, the corresponding axes of rotors of the adjacent modules NM are positioned at an angle $\lambda=180°/n$ , where 'n' is a positive integer number of modules in the engine, wherein 'n' starts from 2. For example, for n=2: $\lambda=180/2=90°$; for n=3: $\lambda=180/3=60°$; for n=4: $\lambda=180/4=45°$; etc.

Assembling Module Engines Into a Power Installation

Generally, a power installation may comprise 'k' of the 'n'-module engines described above, wherein 'k' is a positive integer number starting from 2. This may be needed where power of more than 1000 h.p. is required. For instance, such power installation may deploy one common power takeoff gear (S) as shown on FIG. C3*b*. This power installation comprises two two-NM-module engines rotating two shafts CL connected to the gear S that revolves the fly-wheel CH.

The installation, shown on FIG. C3*b*, may deploy either one or both of the two-module engines depending on the required power. Other installation embodiments may utilize different known types of takeoff gear, and different arrangements of the takeoff shafts. Such installations can find application in heavy long-distance and open pit trucks, large buses, tanks, escalators, small vessels and airplanes.

We claim:

1. A two-stroke opposite radial rotary-piston engine comprising:

an intake channel;

an exhaust channel;

four slides of a hydro-lock; and at least one module having a predetermined stroke length, said module including a stationary housing;

a stationary cylinder block assembled with the stationary housing;

two cylindrically shaped sleeves mounted on said block, each having inner sidewalls;

an upper pair of pistons and a lower pair of pistons, wherein each of said pistons has a rod and a head Sit uated oppositely to the rod, wherein one piston of the upper pair and one piston of the lower pair are slidely disposed within one of said sleeves, wherein the other piston of the upper pair and the other piston of the lower pair are slidely disposed within the other said sleeve, wherein the pistons positioned in each of said sleeves are oppositely linearly movable in relation to each other forming a common chamber defined by the pistons' heads, and wherein a portion of the inner sidewalls of the each of said sleeves is situated between the heads;

a power takeoff shaft revolvably supported substantially by the stationary housing;

two substantially identical rotors fixedly mounted on the takeoff shaft outwardly in relation to the stationary housing, wherein each of said rotors includes an inner operation surface, facing the stationary housing, and is formed by a predeterminedly curved line of a closed type having a transverse axe and a longitudinal axe, wherein the corresponding axes of the two rotors are aligned in parallel, and wherein the each of said rotors on the frontal part of its outer surface includes a peripheral concaved surface portion made therein along said curved line;

an upper cross-shaped traverse pair-wise spanning the rods of said upper pistons attached thereto, and a lower cross-shaped traverse pair-wise spanning the rods of said lower pistons attached thereto;

two pairs of engagement units, wherein each of said two pairs of the engagement units is associated with one of said traverses, and wherein said engagement units operatively cooperate with said concaved surface portions of the rotors;

two pairs of support bearings, wherein each of said two pairs of the support bearings is coupled to one of said traverses, and wherein each of said two pairs of the support bearings includes an external bushing operatively rolling over the inner surface of the rotor, wherein said rolling impels the rotor; and guiding bearings essentially secured to the block and to the traverses, and mounted in the region of contact of said support bearings with said rotors, wherein each of said traverses has a nest, arranged for mounting one of said four slides.

2. The engine according to claim 1, wherein said sleeves, each has an inlet window and an outlet window of predetermined sizes and configurations, made in the inner sidewalls at predetermined locations, said inlet and outlet windows correspondingly communicate with said intake channel and said exhaust channel; and said sleeves include orifices of predetermined sizes and having predetermined locations, said orifices communicating with the intake channel.

3. The engine according to claim 2, wherein said orifices are aligned at a tangential direction to the sidewalls of said sleeves.

4. The engine according to claim 1, wherein said support bearings are of a slipper type.

5. The engine according to claim 1, wherein said predeterminedly curved line is a Cassini line of a closed type.

6. The engine according to claim 5, wherein said Cassini line is an oval.

7. The engine according to claim 6, wherein said oval is so configured that the length difference between the longitudinal axe and the transverse axe of said oval is equal to a double length of the stroke of said pistons.

8. A two-stroke opposite radial rotary-piston engine comprising:

an intake channel;

an exhaust channel, a common fly-wheel;

a front cover, a rear cover; and a plurality of 'n' modules, said 'n' being a positive integer number starting from 2, said plurality of modules assembled together and associated with a common power takeoff shaft, and said plurality of modules includes a beginning module and an ending module; wherein each of said plurality of modules further includes:

a stationary housing substantially supporting a corresponding portion of the common shaft extending therethrough;

a stationary cylinder block assembled with the stationary housing;

two cylindrically shaped sleeves mounted on said block, each having inner sidewalls;

an upper pair of pistons and a lower pair of pistons, wherein each of said pistons has and a head situated oppositely to the rod, wherein one piston of the upper pair and one piston of the lower pair are slidely disposed within one of said sleeves, wherein the other piston of the upper pair and the other piston of the lower pair are slidely disposed within the other said sleeve, wherein the pistons positioned in each of said sleeves are oppositely linearly movable in relation to each other forming a common chamber defined by the pistons' heads, and wherein a portion of the inner sidewalls of the each of said sleeves is situated between the heads;

two substantially identical rotors fixedly mounted on the takeoff shaft outwardly in relation to the stationary housing, wherein each of said rotors has an inner operation surface, facing the stationary housing, and formed by a predeterminedly curved line of a closed type having a transverse axe and a longitudinal axe, wherein the corresponding axes of the two rotors of said module are aligned in parallel, and wherein the each of said rotors each on the frontal part of its outer surface includes a peripheral concaved surface portion made therein along said curved line;

an upper cross-shaped traverse pair-wise spanning the rods of said upper pistons attached thereto, and a lower cross-shaped traverse pair-wise spanning the rods of said lower pistons attached thereto;

two pairs of engagement units, wherein each of said two pairs of the engagement units is associated with one of said traverses, and wherein said engagement units operatively cooperate with said concaved surface portions of the rotors;

two pairs of support bearings, wherein each of said two pairs of the support bearings is coupled to one of said traverses, wherein each of said two pairs of the said support bearings includes an external bushing operatively rolling over the inner surface of the rotor, and wherein said rolling impels the rotor; and guiding bearings essentially secured to the block and to the traverses, and mounted in the region of contact of said support bearings with said rotors;

wherein the corresponding axes of said rotors of the adjacent modules are positioned at an angle $\lambda=180°/n$ in relation to each other, wherein said common fly-wheel is connected to the ending module;

wherein said front cover is disposed at a terminating end of the beginning module and covering the left rotor thereof, wherein said rear cover is disposed at a terminating end of the ending module and covering the right rotor thereof, and wherein a number 'n-1' of said intermediate covers inserted between each two adjacent modules of said 'n' modules and covering the adjacent rotors thereof.

9. The engine according to claim 8, wherein said sleeves, each has an inlet window and an outlet window of predetermined sizes and configurations, is made in the inner sidewalls at predetermined locations, said inlet and outlet windows correspondingly communicate with said intake channel and said exhaust channel; and said sleeves include orifices of predetermined sizes and having predetermined locations, said orifices communicating with the intake channel.

10. The engine according to claim 8, wherein said orifices are aligned at a tangential direction to the sidewalls of said sleeves.

11. The engine according to claim 8, wherein said support bearings are of a slipper type.

12. The engine according to claim 8, wherein said predeterminedly curved line is a Cassini line of a closed type.

13. The engine according to claim 8, wherein said Cassini line is an oval.

14. The engine according to claim 8, wherein said oval is so configured that the length difference between the longitudinal axe and the transverse axe of said oval is equal to a double length of the stroke of said pistons.

15. A power installation comprising a power takeoff gear;

at least two engines according to claim 8, said common takeoff shafts associated through a conventional clutch with said power takeoff gear.

16. A two-stroke opposite radial rotary-piston engine comprising:

an intake channel;

an exhaust channel, four slides of a hydro-lock; and a plurality of 'n' modules, said 'n' being a positive integer number starting from 2, said plurality of modules assembled together and associated with a common power takeoff shaft, and said plurality of modules includes a beginning module and an ending module; wherein each of said plurality of modules further includes:

a stationary housing substantially supporting a corresponding portion of the common shaft extending therethrough;

a stationary cylinder block assembled with the stationary housing;

two cylindrically shaped sleeves mounted on said block, each having inner sidewalls;

an upper pair of pistons and a lower pair of pistons, wherein each of said pistons has and a head situated oppositely to the rod, wherein one piston of the upper pair and one piston of the lower pair are slidely disposed within one of said sleeves, wherein the other piston of the upper pair and the other piston of the lower pair are slidely disposed within the other said sleeve, wherein the pistons positioned in each of said sleeves are oppositely linearly movable in relation to each other forming a common chamber defined by the pistons' heads, and wherein a portion of the inner sidewalls of the each of said sleeves is situated between the heads;

two substantially identical rotors fixedly mounted on the takeoff shaft outwardly in relation to the stationary housing, wherein each of said rotors has an inner operation surface, facing the stationary housing, and formed by a predeterminedly curved line of a closed type having a transverse axe and a longitudinal axe, wherein the corresponding axes of the two rotors of said module are aligned in parallel, and wherein the each of said rotors each on the frontal part of its outer surface includes a peripheral concaved surface portion made therein along said curved line;

an upper cross-shaped traverse pair-wise spanning the rods of said upper pistons attached thereto, and a lower cross-shaped traverse pair-wise spanning the rods of said lower pistons attached thereto;

two pairs of engagement units, wherein each of said two pairs of the engagement units is associated with one of said traverses, and wherein said engagement units operatively cooperate with said concaved surface portions of the rotors;

two pairs of support bearings, wherein each of said two pairs of the support bearings is coupled to one of said traverses, wherein each of said two pairs of the support bearings includes an external bushing operatively rolling over the inner surface of the rotor, and wherein said rolling impels the rotor; and guiding bearings essentially secured to the block and to the traverses, and mounted in the region of contact of said support bearings with said rotors;

wherein the corresponding axes of said rotors of the adjacent modules are positioned at an angle $\lambda=180°/n$ in relation to each other, and wherein each of said traverses has a nest, arranged for mounting one of said four slides.

* * * * *